United States Patent [19]

Biddlecombe

[11] Patent Number: 4,840,370

[45] Date of Patent: Jun. 20, 1989

[54] HAND AND DIGIT EXERCISER

[76] Inventor: Thomas W. Biddlecombe, 3 Burne Court, Kew, Victoria, Australia, 3101

[21] Appl. No.: 285,325

[22] Filed: Jul. 22, 1981

[30] Foreign Application Priority Data

Jul. 29, 1980 [AU] Australia ..... PE4742

[51] Int. Cl.[4] ..... A63B 21/30

[52] U.S. Cl. ..... 272/68; 5/445

[58] Field of Search ..... 272/67, 68; 5/445

[56] References Cited

U.S. PATENT DOCUMENTS

| | | | |
|---|---|---|---|
| 228,004 | 7/1973 | Riccio | 272/67 |
| 802,026 | 10/1905 | Beall | 272/67 |
| 2,994,530 | 8/1961 | Cohan | 272/68 |
| 3,129,939 | 4/1964 | Stock | 272/68 |
| 3,265,389 | 8/1966 | Carlson | 272/68 |
| 3,326,550 | 6/1967 | Melchiona | 272/68 |
| 3,413,243 | 11/1968 | Griffin | 272/67 |
| 3,611,807 | 10/1971 | Brandell | 272/68 |
| 4,278,248 | 7/1981 | Kifferstein | 272/68 |

OTHER PUBLICATIONS

"Portable Gym", Instructions provided by Korfund Dynamics Corp., Westbury, N.Y., 1980.

*Primary Examiner*—Richard J. Johnson

*Attorney, Agent, or Firm*—Cushman, Darby & Cushman

[57] ABSTRACT

A hand and digit exerciser comprising a block of resilient material having a cross-section incorporating a flat base, a convex rounded leading edge extending upwardly and forwardly from said base merging into an upper surface. The exerciser is placed on a flat surface with the forearm of the user extending along that surface. The palm of the hand is placed over the rounded leading edge with the fingers extending along the upper surface.

10 Claims, 2 Drawing Sheets

HAND AND DIGIT EXERCISER

This invention relates to a hand and digit exerciser and has been devised particularly though not solely for exercising hands which are weak from illnesses such as arthritis or cerebro vascular accidents.

In the past the people having weak hand muscles as a result of illnesses such as arthritis or as a result of cerebro vascular accidents have been given exercises for their hand muscles using apparatus which is designed for unaffected hands. Exercising on this type of apparatus tends to develop functionally undesired movements and deformity as the apparatus does not encourage the maintenance of a satisfactory position during exercising. With deformed digits there may also be some difficulty in engaging or holding onto a device designed for unaffected limbs.

It is therefore an object of the present invention to provide a hand digit exerciser which will obviate or minimize the foregoing disadvantages in a simple yet effective manner or which will at least provide the public with a useful choice.

Accordingly the invention consists in a hand and digit exerciser comprising a block of resilient material having a cross-section incorporating a flat base, a convex rounded leading edge extending upwardly and forwardly from said base merging into an upper surface, sized and shaped such that the base may be placed upon a flat surface with the forearm of the user extending along that surface, the palm of the hand placed over the rounded leading edge and the fingers extending along the upper surface, said block incorporating a reinforcing member positioned therewithin and arranged to substantially retain the shape of the rounded leading edge when the remainder of the block is deformed by the fingers of the user.

Figure 1:
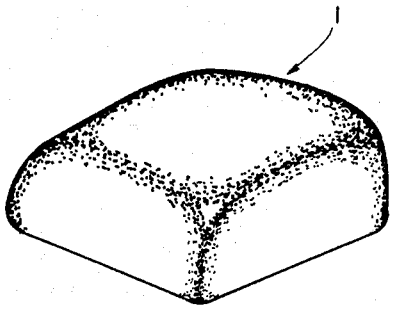
Figure 2:
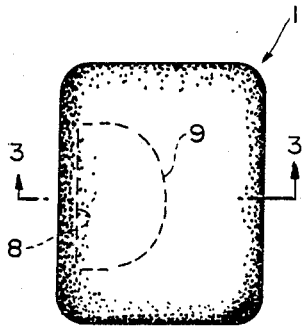
Figure 3:
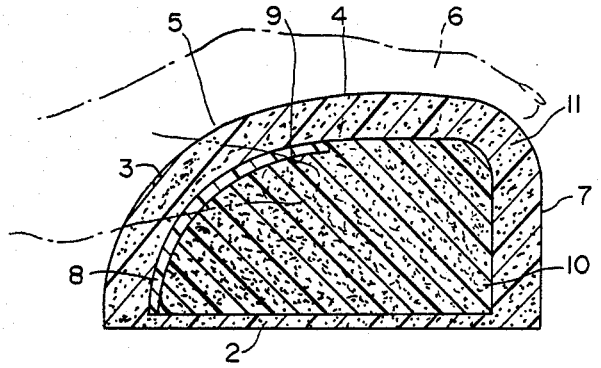
Figure 4:
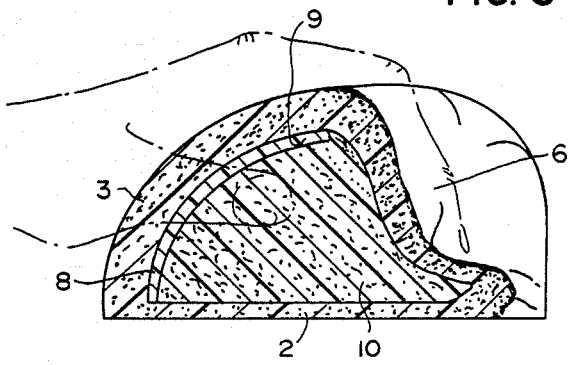
Figure 5:
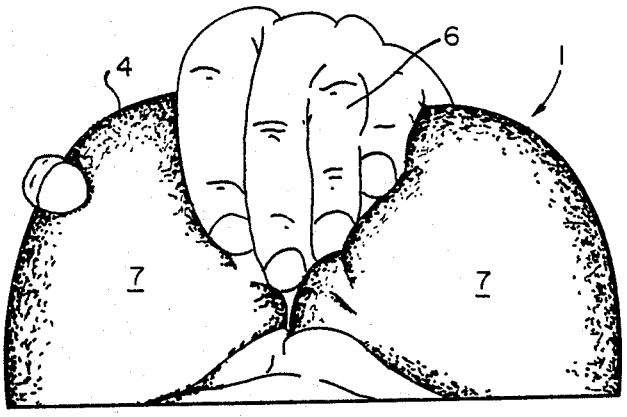
Figure 6:
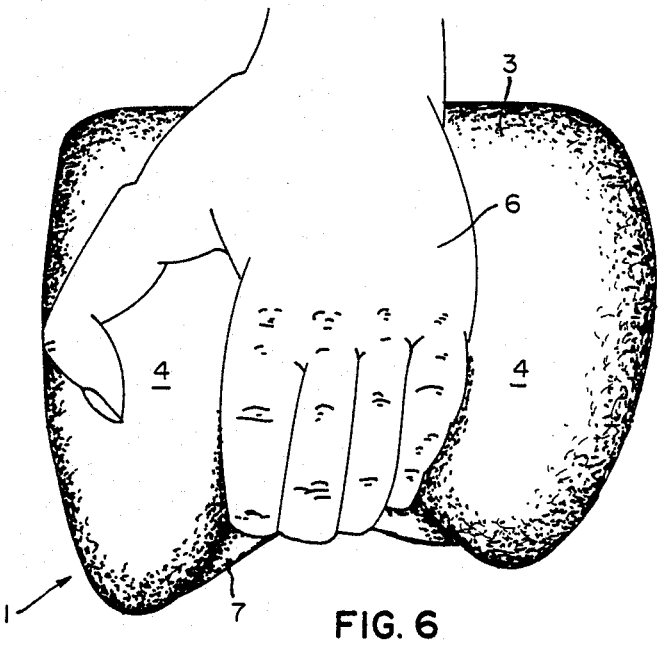

Notwithstanding any other forms that may fall within its scope one preferred form of the invention will now be described by way of example only with reference to the accompanying drawings in which:

FIG. 1 is a perspective view of a hand and digit exerciser according to the invention, FIG. 2 is a plan view of the exerciser shown in FIG. 1, FIG. 3 is a cross-sectional elevation on the line 3—3 of FIG. 2 showing the hand of a user placed in a relaxed condition on the exerciser, FIG. 4 is a view corresponding to FIG. 3 showing the exerciser compressed by the hand of the user, FIG. 5 is an end elevation of the configuration shown in FIG. 4, and FIG. 6 is a plan view of the configuration shown in FIGS. 4 and 5.

In the preferred form of the invention a hand and digit exerciser is constructed as follows:

The exerciser comprises a block of resilient material 1 such as foamed plastics or foamed rubber material which has a generally rectangular plan view configuration as may be seen in FIG. 2. The cross-sectional shape of the block of resilient material which is generally consistent from side to side of the block will now be described in greater detail with reference to FIG. 3. The block has a flat base 2 and a convex rounded leading edge 3 extending upwardly and forwardly on the base and merging into an upper surface 4. The block is sized and shaped such that the base 2 may be placed upon a flat surface such as a table top with the forearm of the user extending along the table top, the palm of the hand 5 placed over the rounded leading edge and the fingers 6 extending along the upper surface 4. The length of the block is conveniently arranged to terminate at a vertical edge 7 at approximately the position of the fingertips of the user.

The resilient block is internally reinforced by a reinforcing member 8 arranged to maintain the shape of the convex rounded leading edge during compression of the block by the fingertips of the user as may be clearly seen in FIG. 4. In the preferred form of the invention the reinforcing member comprises a curved portion of rigid or semi-rigid sheet material embedded within the block and may be formed for example from polypropylene or from a mouldable plastic such as Orthoplast (Registered Trade Mark). The reinforcing member is moulded or otherwise shaped to a curved configuration following the curve of the convex rounded leading edge 3 and positioned within the block just below the surface of the leading edge and following the contour thereof. It is desirable that the reinforcing member has a small amount of resilience particularly at the upper edge 9.

The reinforcing member is designed to hold the wrist in partial extension, this being the position where the hand develops the most effective grip. The curved reinforcing member subtends an angle of between 77° and 97° and preferably of 87°.

In the preferred form of the invention the block of resilient material comprises an inner block 10 and an outer covering layer 11. The outer covering layer may completely enclose the inner block 10 as shown in the accompanying drawings or alternatively may simply be a covering layer over at least the surfaces of the block which are contacted by the hand of the user. The inner block is of a firmer material than the outer covering layer. In the preferred form of the invention both the inner block and the outer covering layer are formed from foamed polyurethane but it will be appreciated that other resilient materials such as foamed rubber or other foamed plastics materials may be used.

The inner block 10 may typically be a polyurethane foam such as that sold by the Olympic Tyre and Rubber Company Pty. Ltd. as E71 and having a density of 31 kg/m$^3$. This material has internal force deflection of 160 N±13 at 25% compression and 280 N±22 at 65% compression. Although this is the preferred material it is obvious that the exerciser would work with a range of resilience for the inner block such as 80 N–360 N at 25% compression and 140 N–560 N at 65% compression. The outer layer is a softer polyurethane foam such as Olympic PG10 having a density of 26 kg/m$^3$. This material has an internal force deflection of 50 N±9 at 25% compression and 95 N±13 at 65% compression. The resilience of the outer covering layer provides some initial resistance to the fingers when flexion begins and also provides a soft comfortable cover for the hand of the user.

It will be appreciated that an additional layer or layers may be added between the outer covering and the inner block in order to control the degree of resistance offered to the flexing digits.

In use the block is placed upon a flat surface such as a table top and the forearm of the user rested on the table top with the curved leading edge 3 of the resilient block placed in the palm of the hand. The fingers 6 extend along the upper surface 4 of the block. The hand may then be exercised by squeezing the block inwardly against the resilience of the material using the fingers and thumb as shown in FIGS. 4, 5 and 6. This exercise may be repeated for any desired time to give the necessary exercise to the hand digit and forearm muscles. In this manner a hand and digit exerciser is provided which enables the hand and digit muscles to be exercised in a natural position without tending to develop any functionally undesired movements and deformity.

I claim:

1. A hand and digit exerciser comprising a block of resilient material having a cross-section incorporating a flat base, a convex leading edge extending upwardly and forwardly from said base merging into an upper surface sized and shaped such that the base may be placed upon a flat surface with the forearm of the user extending along that surface, the palm of the hand placed over the rounded leading edge and the fingers extending along the upper surface, said block incorporating a reinforcing member positioned therewithin near the rounded leading edge and arranged to substantially retain the shape of the rounded leading edge when the remainder of the block is deformed by the fingers of the user.

2. A hand and digit exerciser as claimed in claim 1 wherein said reinforcing member comprises a curved portion of rigid or semi-rigid sheet material embedded within said block of resilient material beneath the surface of said rounded leading edge and following the contour thereof.

3. A hand and digit exerciser as claimed in claim 1 wherein the length of said block terminates approximately at the position of the fingertips of the user.

4. A hand and digit exerciser as claimed in claim 1 wherein said block of resilient material comprises an inner block and an outer covering layer at least over the surfaces of the block contacted by the hand of the user, the inner block being of a firmer material than the outer covering layer.

5. A hand and digit exerciser as claimed in claim 4 wherein the material of said inner block has an internal force deflection range of 80 N–360 N at 25% compression and 140 N–560 N at 65% compression.

6. A hand and digit exerciser as claimed in claim 4 wherein the material of said inner block has an internal force deflection of 160±13 at 25% compression and 280 N±22 at 65% compression.

7. A hand and digit exerciser as claimed in claim 1 wherein said resilient material comprises foamed poylurethane.

8. A hand and digit exerciser as claimed in claim 4 wherein said reinforcing member is located between said inner block and said outer covering layer.

9. A hand and digit exerciser as claimed in claim 2 wherein said reinforcing member subtends an arc 77° to 97°.

10. A hand and digit exerciser comprising a block of resilient material having a flat horizontal base for engagement with a flat supporting surface block in plan view having a generally rectangular profile, one of the longer upright edges of the rectangular profile being convex and rounded throughout its height and merging into a generally horizontal upper surface, the other longer edge of the rectangular profile and the two shorter edges of the rectangular profile being generally vertical, the dimensions of said rounded edge and upper surface being such that when the palm of the hand is placed on said rounded edge the fingers of the hand overlie and extend along said upper surface with the finger tips lying approximately at the junction of said upper surface with said other longer edge, said block incorporating an internal generally arcuate reinforcing member of a material which is more rigid than the resilient material of said block, said member being embedded within said block at the location of said rounded edge and following the contour thereof, said member having an upper edge terminating at approximately the junction of said rounded edge with said upper surface.

* * * * *